US012613080B2

(12) United States Patent
Mencotti

(10) Patent No.: US 12,613,080 B2
(45) Date of Patent: Apr. 28, 2026

(54) SYSTEMS AND METHODS FOR ACCURACY ASSISTANCE CALCULATION AND DISPLAY ON REMOVABLE DEVICE

(71) Applicant: Marcus Mencotti, Commerce Township, MI (US)

(72) Inventor: Marcus Mencotti, Commerce Township, MI (US)

( * ) Notice: Subject to any disclaimer, the term of this patent is extended or adjusted under 35 U.S.C. 154(b) by 0 days.

(21) Appl. No.: 18/628,971

(22) Filed: Apr. 8, 2024

(65) Prior Publication Data

US 2024/0337464 A1 Oct. 10, 2024

Related U.S. Application Data

(60) Provisional application No. 63/457,544, filed on Apr. 6, 2023.

(51) Int. Cl.
*G06F 19/00* (2018.01)
*F41G 3/08* (2006.01)
*F41G 1/38* (2006.01)

(52) U.S. Cl.
CPC . *F41G 3/08* (2013.01); *F41G 1/38* (2013.01)

(58) Field of Classification Search
CPC ..... F41G 3/08; F41G 3/06; F41G 1/38; F41G 3/12; F41G 3/2644; F41G 1/033
USPC ..... 235/417
See application file for complete search history.

(56) References Cited

U.S. PATENT DOCUMENTS

| | | | | |
|---|---|---|---|---|
| 3,552,053 | A | 1/1971 | Jarvis | |
| 5,299,067 | A | 3/1994 | Kutz et al. | |
| 5,375,072 | A | 12/1994 | Cohen | |
| 5,546,691 | A | 8/1996 | Allison | |
| 6,252,706 | B1 | 6/2001 | Kaladgew | |
| 6,269,581 | B1 | 8/2001 | Groh | |
| 7,421,816 | B2 | 9/2008 | Conescu | |
| 7,624,528 | B1 | 12/2009 | Bell et al. | |
| 7,647,721 | B1 | 1/2010 | Gaber et al. | |
| 7,797,873 | B2 | 9/2010 | Gering et al. | |
| 8,571,398 | B1 | 10/2013 | Goddard et al. | |
| 9,074,846 | B2 | 7/2015 | Mencotti | |
| 2007/0277421 | A1 | 12/2007 | Perkins et al. | |
| 2011/0168777 | A1 | 7/2011 | Bay | |
| 2011/0249335 | A1 | 10/2011 | Strawderman et al. | |
| 2019/0316878 | A1 * | 10/2019 | Beckman | F41G 11/00 |
| 2020/0232762 | A1 * | 7/2020 | Hamilton | F41A 9/62 |
| 2021/0180917 | A1 * | 6/2021 | Dikun | F41G 3/06 |
| 2022/0057519 | A1 * | 2/2022 | Goldstein | G01S 17/88 |
| 2022/0196366 | A1 * | 6/2022 | Beckman | F41G 1/38 |
| 2022/0283440 | A1 * | 9/2022 | VanBecelaere | F41G 1/473 |
| 2023/0384058 | A1 * | 11/2023 | Maryfield | F41G 3/08 |

* cited by examiner

*Primary Examiner* — Daniel St Cyr
(74) *Attorney, Agent, or Firm* — Dickinson Wright PLLC

(57) ABSTRACT

A removable optics attachment for a weapon includes a first display, at least one sensor, at least one wireless communication circuit for sending an receiving data, and a processor. The processor is programed to: receive environmental data from an information network and the at least one sensor; receive user account data from the information network; determine bullet drop compensation data based on the environmental data and the user account data; and display the bullet drop compensation data on the first display.

17 Claims, 5 Drawing Sheets

SYSTEMS AND METHODS FOR ACCURACY ASSISTANCE CALCULATION AND DISPLAY ON REMOVABLE DEVICE

CROSS-REFERENCE TO RELATED APPLICATION

The present disclosure claims the benefit of Provisional Patent Application No. 63/457,544, filed on Apr. 6, 2023 and titled "SYSTEMS AND METHODS FOR ACCURACY ASSISTANCE CALCULATION AND DISPLAY ON A REMOVABLE DEVICE", the contents of which are incorporated by reference in it entirety.

TECHNICAL FIELD

The present application relates to firearms. More particularly, the present disclosure relates to a system and method for calculating and communicating bullet drop compensation data based in part on real time sensor outputs.

BACKGROUND

Firearms are commonly used for various purposes, including hunting, sport shooting and law enforcement. A challenge associated with shooting, especially at long ranges, is compensating for bullet trajectory changes caused by external factors like gravity and wind. Typically, the greater the distance, the more the trajectory is affected by environmental forces. Long range shooters must calculate how to compensate for such external factors. Also, calculations may need to be updated as environmental forces change in real time. Although certain solutions exist for providing bullet drop data in real time, they typically require expensive optical equipment.

There is a need for a low cost bullet drop compensation calculation and display for long range shooters without the need for expensive electronic optical equipment.

SUMMARY

Described herein is an embodiment of a removable optics attachment for a weapon including a first display, at least one sensor, at least one wireless communication circuit for sending an receiving data, and a processor. The processor is programed to: receive environmental data from an information network and the at least one sensor; receive user account data from the information network; determine bullet drop compensation data based on the environmental data and the user account data; and display the bullet drop compensation data on the first display.

An embodiment of the subject disclosure relates to a method for determining bullet drop compensation for a weapon. The method includes obtaining user data from a user, wherein the user data includes at least one of: a distance to a target, a scope attribute, a bullet caliber, a bullet grain, a muzzle length, or a barrel twist of the weapon; obtaining conditional data from a sensor, wherein the conditional data includes at least one of: a weather reading, wind speed, wind direction, temperature, humidity, relative humidity, elevation, air pressure, location, an orientation of the weapon, or time; obtaining informational data from an information network, wherein the informational data includes at least one of: a weather reading, elevation, an emergency warning, user account data, user history data, or time; calculating bullet drop compensation data based on the user data, the conditional data, and the informational data; generating a bullet drop compensation distance and a bullet drop compensation rate based on the bullet drop compensation data; and determining a scope adjustment value based on the bullet drop compensation distance, the bullet drop compensation rate, and the scope attribute.

An embodiment of the subject disclosure relates to a method of communicating bullet drop compensation to a user aiming a weapon. The method includes calculating bullet drop compensation data; determining an orientation adjustment for an orientation of the weapon based on the bullet drop compensation data; detecting a change in the orientation of the weapon; and outputting a notification to the user based on a comparison of the orientation of the weapon and the orientation adjustment.

Another embodiment of a method of communicating bullet drop compensation to a user aiming a weapon includes calculating bullet drop compensation data; determining an optical adjustment value for an optical attachment of the weapon based on the bullet drop compensation data and a measurement displayed by the optical attachment; and displaying the optical adjustment value on a display.

An embodiment of the subject disclosure relates to a method of communicating bullet drop compensation to a user. The method includes displaying relevant data of a first set of conditional data on a display; receiving an input from a user to adjust the relevant data of the first set of conditional data displayed on the display; storing the input from the user and the first set of conditional data as training data; training a machine learning model with the training data; obtaining a second set of conditional data; generating a confidence score for the second set of conditional data based on the training data; ranking the second set of conditional data based on the confidence score and based on the user adjusting the relevant data of the first set of conditional data displayed on the display, wherein the first set of conditional data is similar to the second set of conditional data; and displaying the relevant data of the second set of conditional data with the highest rank on the display.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

BRIEF DESCRIPTION OF THE DRAWINGS

Aspects of the present disclosure are illustrated by way of example and are not limited by the accompanying figures for which like references indicate like elements.

DETAILED DESCRIPTION

Figure 1:
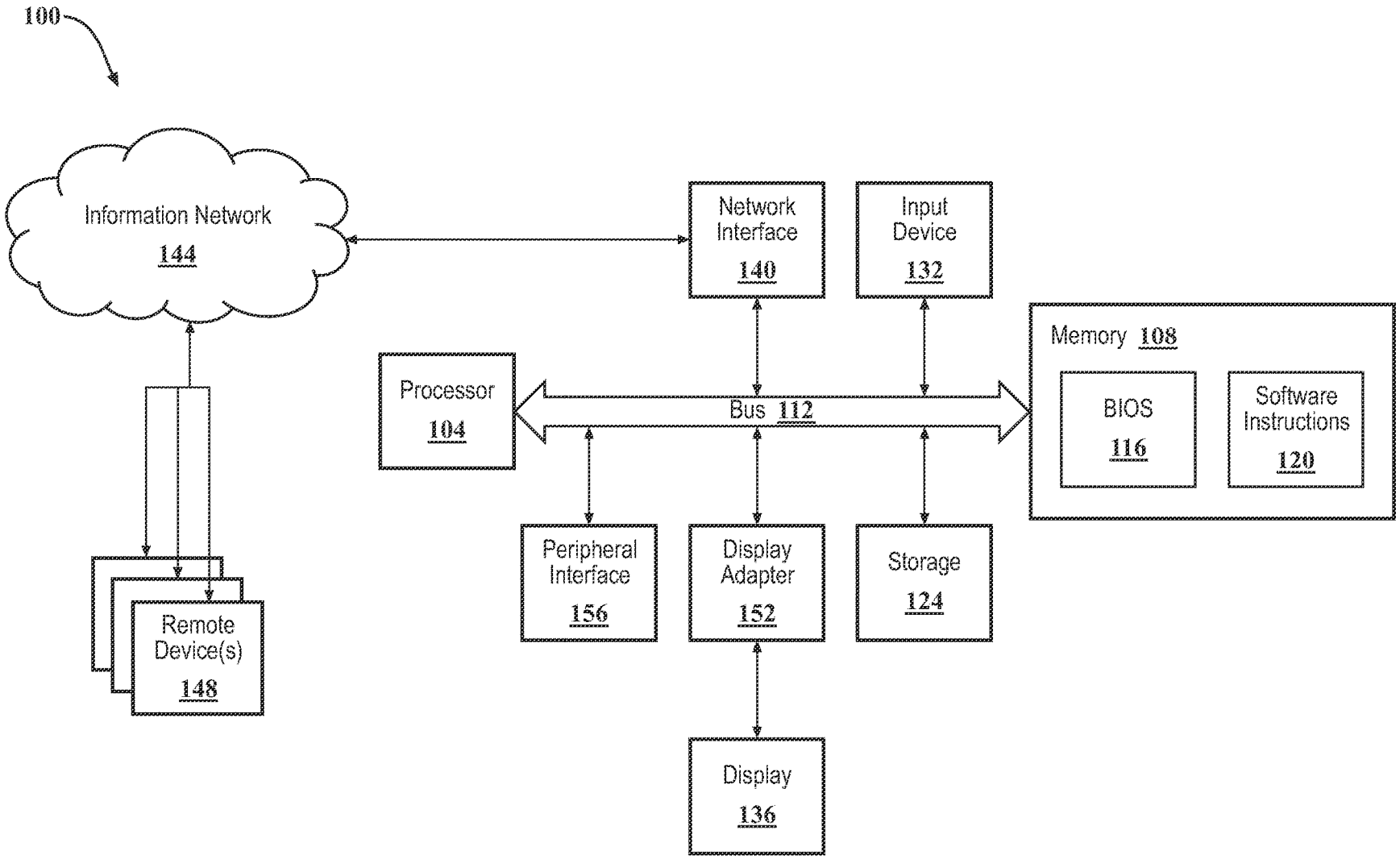
FIG. 1 generally illustrates a computing system, according to an embodiment of the present disclosure.

FIG. 1 shows an example embodiment of a computing system 100 for implementing embodiments of the disclosure. The computer system 100 includes a processor 104 and a memory 108 that communicate with each other, and with other components, via a bus 112. The processor 104 may be a single core processor, a multi core processor, or a network of processors working together. The bus 112 may include any of several types of bus structures including, but not limited to, a memory bus, a memory controller, a peripheral bus, a local bus, and any combinations thereof, using any of a variety of bus architectures.

The memory 108 may include various components (e.g., machine-readable media) including, but not limited to, a random-access memory component, a read-only component, and any combinations thereof. In one example, a basic input/output system 116 (BIOS), including basic routines that help to transfer information between elements within computer system 100, such as during start-up, may be stored in memory 108. The memory 108 may also include (e.g., stored on one or more machine-readable media) instructions (e.g., software) 120 embodying any one or more of the aspects and/or methodologies of the present disclosure. In another example, memory 108 may further include any number of program modules including, but not limited to, an operating system, one or more application programs, other program modules, program data, and any combinations thereof.

The computer system 100 may also include a storage device 124. Examples of a storage device (e.g., storage device 124) include, but are not limited to, a hard disk drive, a magnetic disk drive, an optical disc drive in combination with an optical medium, a solid-state memory device, and any combinations thereof. The storage device 124 may be connected to bus 112 by an appropriate interface (not shown). Example interfaces include, but are not limited to, SCSI, advanced technology attachment (ATA), serial ATA, universal serial bus (USB), IEEE 1394 (FIREWIRE), and any combinations thereof. In one example, the storage device 124 (or one or more components thereof) may be removably interfaced with the computer system 100 (e.g., via an external port connector (not shown)). Particularly, the storage device 124 and an associated machine-readable medium 128 may provide nonvolatile and/or volatile storage of machine-readable instructions, data structures, program modules, and/or other data for computer system 100. In one example, the instructions 120 may reside, completely or partially, within machine-readable medium 128. In another example, the instructions 120 may reside, completely or partially, within the processor 104.

The computer system 100 may also include an input device 132. In one example, a user of the computer system 100 may enter commands and/or other information into the computer system 100 via an input device 132. Examples of the input device 132 includes, but are not limited to, an alphanumeric input device (e.g., a keyboard), a pointing device, a joystick, a gamepad, an audio input device (e.g., a microphone, a voice response system, etc.), a cursor control device (e.g., a mouse), a touchpad, an optical scanner, a video capture device (e.g., a still camera, a video camera), a touchscreen, and any combinations thereof. The input device 132 may be interfaced to the bus 112 via any of a variety of interfaces (not shown) including, but not limited to, a serial interface, a parallel interface, a game port, a USB interface, a FIREWIRE interface, a direct interface to the bus 112, and any combinations thereof. The input device 132 may include a touch screen interface that may be a part of or separate from display 136, discussed further below. The input device 132 may be utilized as a user selection device for selecting one or more graphical representations in a graphical interface as described above.

A user may also input commands and/or other information to the computer system 100 via the storage device 124 (e.g., a removable disk drive, a flash drive, etc.) and/or the network interface device 140. The network interface device 140 may be utilized for connecting the computer system 100 to one or more of a variety of networks, such as an information network 144, and one or more remote devices 148 connected thereto. Examples of the network interface device 140 include, but are not limited to, a network interface card (e.g., a mobile network interface card, a LAN card), a modem, and any combination thereof. Examples of a network include, but are not limited to, a wide area network (e.g., the Internet, an enterprise network), a local area network (e.g., a network associated with an office, a building, a campus, or other relatively small geographic space), a telephone network, a data network associated with a telephone/voice provider (e.g., a mobile communications provider data and/or voice network), a direct connection between two computing devices, and any combinations thereof. A network, such as the information network 144, may employ a wired and/or a wireless mode of communication. In general, any network topology may be used. Information (e.g., data, instructions 120, etc.) may be communicated to and/or from the computer system 100 via the network interface device 140.

Computer system 100 may further include a video display adapter 152 for communicating a displayable image to a display device 136. Examples of the display device 136 include, but are not limited to, a liquid crystal display (LCD), a cathode ray tube (CRT), a plasma display, a light emitting diode (LED) display, and any combinations thereof. The display adapter 152 and the display device 136 may be utilized in combination with the processor 104 to provide graphical representations of aspects of the present disclosure. In addition to the display device 136, the computer system 100 may include one or more other peripheral output devices including, but not limited to, an audio speaker, a printer, and any combinations thereof. Such peripheral output devices may be connected to the bus 112 via a peripheral interface 156. Examples of the peripheral interface 156 include, but are not limited to, a serial port, a USB connection, a FIREWIRE connection, a parallel connection, and any combinations thereof.

Figure 2:
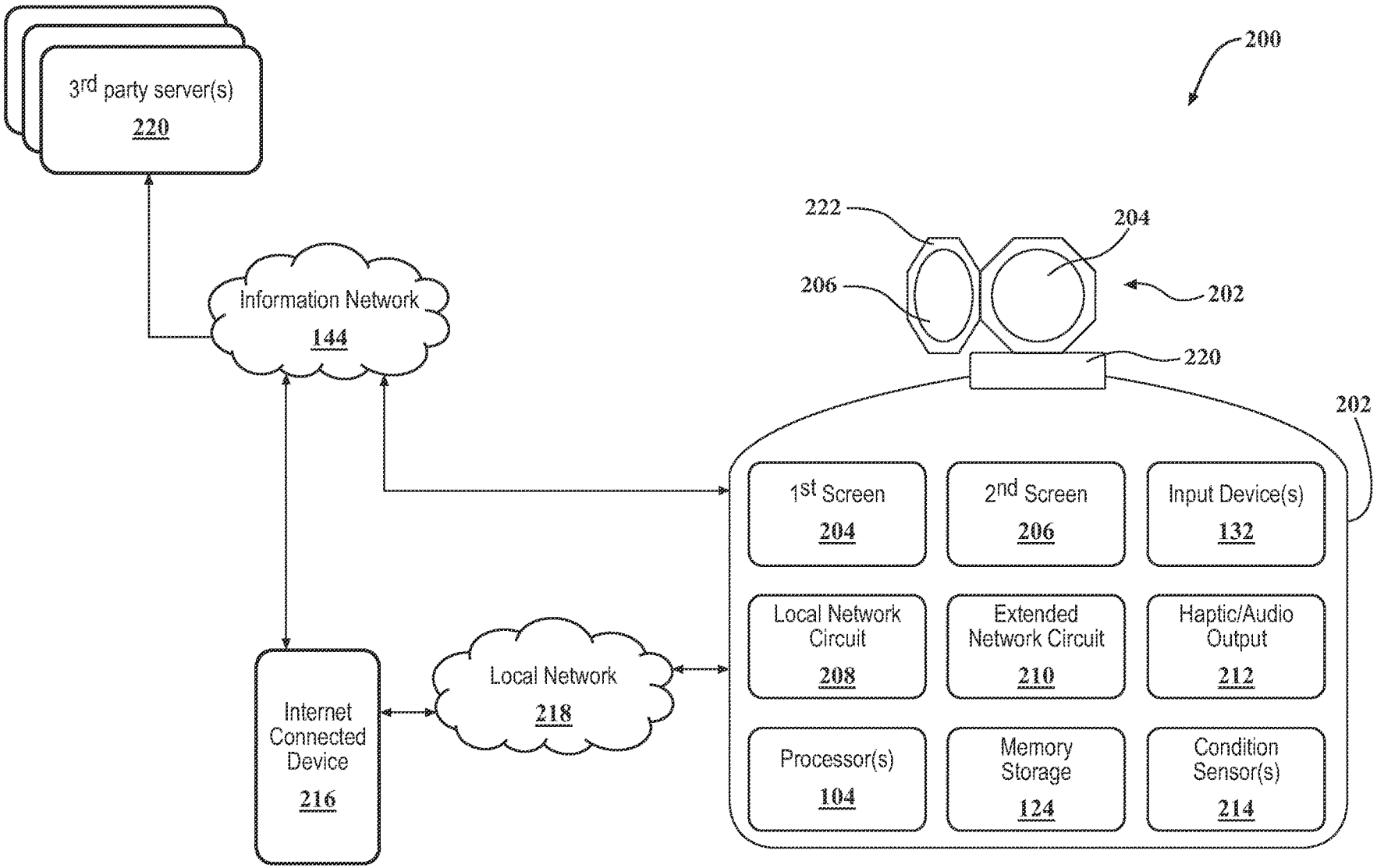
FIG. 2 generally illustrates a computing environment and a removable device, according to an embodiment of the present disclosure.

FIG. 2 generally illustrates a computing environment 200 of the disclosed invention. In some embodiments, the computing environment 200 may include a removable device 202, a local network 218, an internet connected device 216, the information network 144, and one or more servers 220. In some embodiments, the local network 218 may include circuitry designed to send and receive data using: BLUETOOTH, wireless fidelity (WIFI), ultra wide band (UWB), infrared (IR), or any other suitable short range communication. In some embodiments, the internet connected device 216 may be a cellular cable device such as, but not limited to: a cell phone, a smartphone, mobile phone, a tablet, a laptop, smart watch, smart glasses, smart clothing, other smart devices, or any combination thereof. In some embodiments the servers 220 may include a system servers, one or more 3rd party servers, or any internet connected server. In some embodiments, the 3rd party servers may be used to retrieve: weather data, rifle data, scope data, optics data, bullet data, emergency warning data, and the like.

As shown in FIG. 2, in an embodiment the removable device 202 may be attached to a firearm (e.g., a rifle) or scope for a firearm via a mounting ring 220 and a lens cap 222 may be pivotally attached to the mounting ring 220. The terms firearm and rifle are used interchangeably herein. In some embodiments, the removable device 202 may be a scope or an optical attachment. The term scope and optics are used interchangeably but are intended to refer to any optical enhancement attachment for a firearm. The term firearm may refer to any firearm, e.g., rifle, of any size that may be used with an optical attachment.

In some embodiments, the removable device 202 further comprises the processor 104, a first screen 204, a second screen 206, at least one input device 132, a local network circuit 208, an extended network circuit 210, haptic/audio output device or circuit 212, and at least one condition sensor circuit 214. The screens or displays 204 and 206 may be liquid crystal display (LCD), light-emitting diode (LED), backlit LCD, thin-film transistor (TFT) LCD, quantum dot (QLED), display Light-emitting diode (LED) display, organic LED (OLED), AMOLED, Super AMOLED, e-ink display, holographic projection, or any other suitable display technology. For example, in certain embodiments, the first screen 204 and/or the second screen 206 may be a holographic projection that is displayed inside of an ocular lens of the removable device 202, a scope, or an optical attachment. In other words, a user of the removable device 202 is able to look through the ocular lens and view the first screen 204 and/or the second screen 206. The first screen 204 and/or the second screen 206 may also be attached to the mounting ring 220 for displaying information or projecting information. In some embodiments, the lens cap 222 may include the first screen 204 and/or the second screen 206.

The removable device 202 may be used by itself or in conjunction with external devices. For example, external devices with BLUETOOTH connectivity such as rangefinders, Kestrels, devices with internal ballistic calculators, or the like may send information to the removable device 202 via the local network 218. The information from the external devices may be displayed on the first screen 204 and/or the second screen 206.

In some embodiments the at least one input device 132 may be touch sensitive surface (e.g., resistive, surface capacitive touch, projected capacitive (P-Cap), surface acoustic wave (SAW), infrared (IR), and the like), buttons (e.g., keyboard, mouse, joystick, scroll wheel, buttons), virtual inputs presented on an internet connected device, or any suitable input mechanism. In some embodiments the extended network circuit 210 may include, but is not limited to, global system for mobile communication (GSM), general packet radio service (GPRS), code division multiple access (CDMA), MOBITEX, enhanced data for global evolution (EDGE), or some combination thereof.

In some embodiments the haptic/audio output circuit 212 may provide haptic feedback (e.g., force, vibrotactile, electrotactile, ultrasonic, thermal, and the like) as well as audio output (e.g., mono speaker, stereo speakers, headphones, and any other suitable audio output device). In some embodiments the condition sensors 214 may include, but are not limited to: a temperature sensor, soil sensor, temperature and humidity sensor, gas sensor, rainfall sensor, light sensor, wind speed and direction sensors, accelerometer, compass, GPS.

Figure 3:
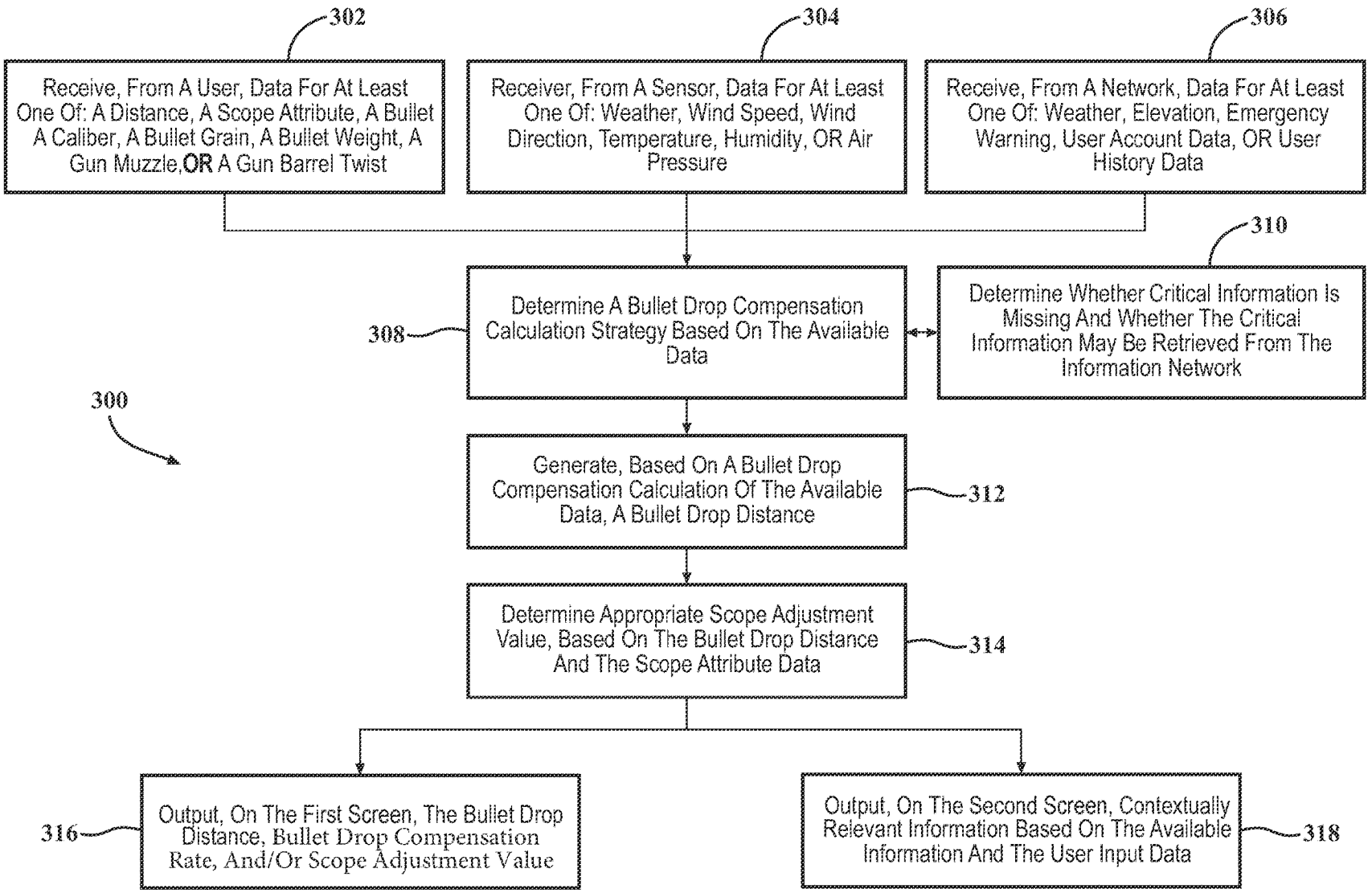
FIG. 3 generally illustrates an example block diagram of a method for communicating bullet drop compensation data, according to an embodiment of the present disclosure.

FIG. 3 generally illustrates a process 300 of a method for communicating bullet drop compensation data. At 302, the process 300 receives data from a user which may be used in the bullet drop compensation calculations. In some embodiments the inputs may be received through input devices 132. In some embodiments, process 300 receives from a user a value associated with at least one of: a distance to a target, a scope attribute, an optics attribute, a bullet, a caliber, a bullet grain, a bullet weight, a rifle muzzle length, or a rifle barrel twist. For example, the user may input a value related to a bullet grain through the internet connected device's 216 on screen keyboard. The internet connected device 216 may communicate that value to the removable device 202 via a local BLUETOOTH connection. In some embodiments, the process 300 is executed on processor 104.

At step 304, the process 300 receives, from the one or more condition sensors 214, information which may be used in the bullet drop compensation calculations. In some embodiments, the information received from the one or more condition sensors 214 may include a value for: weather, wind speed, wind direction, temperature, humidity, relative humidity, elevation, or air pressure. In some embodiments, the information may not be available and, instead, the user may input the information.

At 306, the process 300 receives, from a network, such as the information network 144 and/or local network 218, information which may be used in the bullet drop compensation calculation. In some embodiments, the information may include: weather, elevation, emergency warning, user account data, user history data, or any other suitable information. In some embodiments, the information may not be available and, instead, the user may input the information.

At 308, the process 300 calculates bullet drop compensation data based on the data available. At 310, the process 300 determines that some information is unavailable and instead attempts to retrieve that data via the information network 144 and/or local network 218. In some embodiments, when the information is not available over the information network 144 and/or local network 218, a predetermined default value may be used. For example, when no network connection is available and the value for environmental humidity has not been received, the process 300 may use a default value of 50% humidity. In some embodiments, the default value may be edited by the user or the default value may be based on historical data generated in previous uses by the user, or pulled from another source like the internet or a local cloud.

At 312, the process 300 generates, based on the bullet drop compensation calculation, a bullet drop compensation distance and a bullet drop compensation rate. At 314, the bullet drop compensation data is used to determine the appropriate scope adjustment value. For example, many scopes use one "click" as being equal to an adjustment of ¼ of an inch at 100 yards. The amount of adjustment required to compensate for the drop of the bullet will depend on information related to the scope or optics used with the rifle.

At 316, the process 300 outputs the bullet drop distance, the bullet drop compensation rate, the scope adjustment value, or some combination thereof to the first screen 204. In some embodiments, the first screen 204 may automatically scroll in order to show all the relevant information. In some embodiments, the user may use the input devices 132 to alter the view of the information displayed on the first screen 204 (e.g., scroll through the information or adjust what is shown and remains on the first screen 204).

At 318, the process 300 outputs, to the second screen 206, contextually relevant information based on the available information and the user input data. In some embodiments, the process 300 stores previous user activity regarding what is displayed on the second screen 206. The user may use the input devices 132 to alter which information is displayed, how much information is displayed, and how that information is displayed. Those inputs from the user are monitored and stored to help forecast future information displays for the user. All information related to the display of the second screen 206 ultimately settled upon by the user may be stored as training data to train a machine learning model to predict what the user will display based on previous user behavior and current circumstantial information (i.e., location, time of day, elevation, weather, and any other circumstantial information available to the process 300).

In some embodiments, the process 300 may calculate a wind hold calculation based on the wind speed and direction detected by the one or more condition sensors 214, information retrieved from the information network 144, and/or input from the user. The wind hold calculation may be output on either the first screen 204 or the second screen 206.

In some embodiments, the process 300 may calculate the bullet drop compensation data and elevation data (elevation of the user, elevation of the target, and elevation angle) based on a line of sight distance and an orientation angle of a barrel of the rifle and display the bullet compensation data and the elevation data on the first screen 204 and/or the second screen. In further embodiments, if the user scrolls through saved yard lines on the removable device 202, the process 300 would automatically change the elevation data and bullet compensation data displayed according to the orientation angle of the barrel.

As previously mentioned, external devices may communicate with the removable device 202 via the local network 218, the information network 144, or internet connected device 216 and the external devices may be an ballistic drop compensation turret or Kestrel. In an embodiment, the process 300 may display an input, data, or information from an external device or sensor to the first screen 204 and/or the second screen 206. For example, at 304 and/or 306, the process 300 may receive information from the external device and display the information on the first screen 204 and/or the second screen 206. The process 300 may further display a change or update in the information from the external device after steps 308, 312, and/or 314. In some embodiments, the process 300 may display the change or update in the information from the external device at step 316 and/or step 318. In further embodiments, the process 300 may display the change or update in the information from the external device after input from the user adjusting the external device based on the information displayed at step 316 (e.g., the user may adjust the ballistic drop compensation turret based on the scope adjustment value). The change or update may be indicated by a color change, adjustment of a font such as bolding, underlining, italicizing, a symbol, flash, or the like, or a combination or sub-combination thereof to notify the user that the information has been updated after steps 308, 312, 314, 316, 318, and/or input to the external device from the user.

For example, a Kestrel is in communication with the removable device 202 and a ballistic drop compensation turret is set to 600 yards. At 306, the 600 yard setting of the ballistic drop compensation turret is communicated to the removable device 202 and displayed on the second screen 206 in red text. At 304 and/or 306, the process 300 receives the data from the Kestrel. At 318, the displayed 600 yard setting of the ballistic drop compensation turret on the second screen 206 would be changed from 600 yards to a new yard setting based on the bullet drop distance, bullet drop compensation rate, and/or the scope adjustment value. The new yard setting is displayed with green text to indicate to the user that the calculations and/or step 314 is complete. Alternatively, the new yard setting is initially displayed with blue text and is changed to green text once the ballistic drop compensation turret is adjusted to the new yard setting (i.e., the new yard setting is displayed with blue text to indicate how the ballistic drop compensation turret should be adjusted by the user, and then displayed with green text to indicate the user has adjusted the ballistic drop compensation turret to the proper setting as determined by the process 300).

Figure 4:
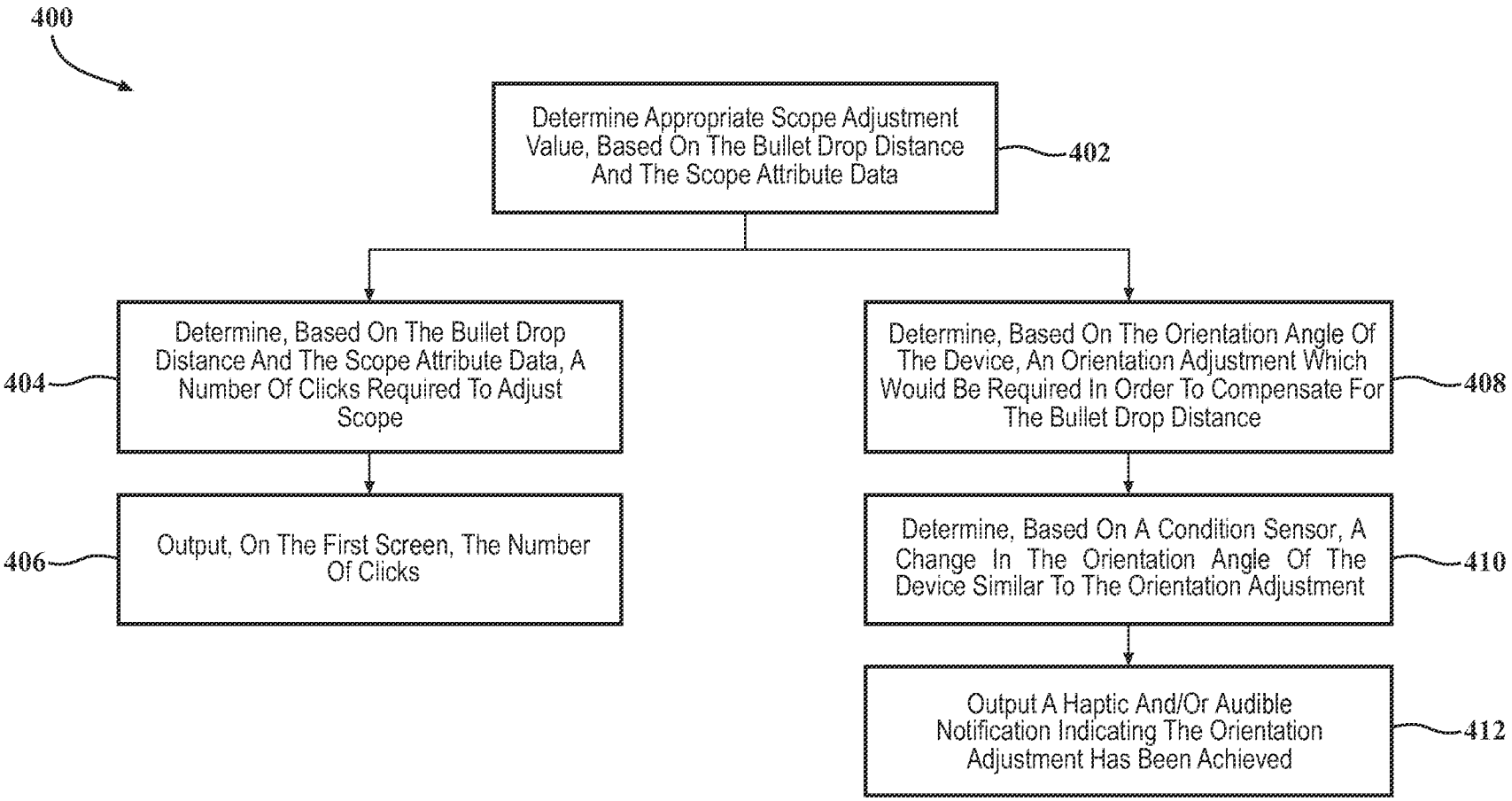
FIG. 4 generally illustrates an example block diagram of a method for communicating bullet drop compensation data, according to an embodiment of the present disclosure.

FIG. 4 generally illustrates process 400 detailing a method for communicating bullet drop compensation data to the user while they are lining up their shot. In some embodiments, the bullet drop compensation data may be updated in real time based on updated readings from the condition sensors 214. In some embodiments, the process 400 is executed on processor 104.

At 402, the process 400 calculates bullet drop compensation data based on the data retrieved from the user, from the internet connected device, the system server, 3rd party servers, or user history data. In some embodiments the amount of compensation required may be output as minutes of angle (MOA) or milliradians (MIL) as well as a direction (e.g., up, down, left, right, or some combination thereof).

At 404, the process 400 may determine, based on the bullet drop distance and scope attribute information, a value of adjustment for the rifle's optical attachment. In some embodiments, the process 400 may further convert the MOA and/or the MIL to a value appropriate to the optics installed on the rifle. For example, a scope may be adjusted based on a number of "clicks" heard when making said adjustment. The process 400 may convert the MOA or MIL to clicks based on the information relating to the rifle's optical attachment. At 406, the process 400 may display the value of adjustment on the first display.

At 408, the process 400 may determine an orientation adjustment required to compensate for the bullet drop distance calculated above. The condition sensors 214 of the removable device 202 may include an accelerometer or other suitable device to determine an orientation angle the removable device 202, and by extension, the rifle itself. Therefore, the process 400 may determine what orientation angle of the rifle is required to compensate for bullet drop. Alternatively, the accelerometer or other suitable device may be attached to the barrel of the rifle an in communication with the removable device 202. For example, where a target is down range of the user the process at 408 may determine that the rifle must be orientated at an upward angle relative to a line of sight to compensate for the bullet drop rate and/or distance.

In some embodiments, at 408, the process 400 may determine the orientation adjustment required to compensate for the bullet drop distance, the wind speed, the wind direction, the elevation of the user and the target, other weather effects (e.g., rain), or the like, or a combination or sub-combination thereof. For example, where the wind is strong in a particular direction, the process 400 may determine that the rifle must be orientated at an angle horizontal to the light of sight and towards the direction of the wind. Additionally, where the user is elevated above the target the process 400 may determine that the rifle need only be oriented at a slight vertical angle relative to the line of sight. However, the orientation angle would still be calculated based on a line of sight distance to account for any potential effects due to the wind.

At 410, the process 400 may determine a change in the orientation angle of the removable device 202 based on information from the condition sensors 214. In some embodiments, the process 400 may track the orientation angle of the removable device 202 and compare the present orientation angle value with the target orientation angle value determined to compensate for the bullet drop rate and/or bullet drop distance.

At 412, the process 400 may output to the user haptic and/or audible feedback from the haptic/audio output device 212 in real time to the user while the user attempts to match the orientation angle of the rifle to the target orientation angle. For example, the user may feel an increased vibration as the present orientation angle begins to match the target orientation angle, in which further vibration indicates the target orientation angle has been achieved. In some embodiments audible feedback may be used to indicate to the user how close or far the present orientation angle is from the target orientation angle and a different form of feedback indicates success. In some embodiments the haptic feedback may be kinesthetic feedback (i.e., simulating the weight or pressure of an object), tactile feedback (i.e., simulating texture), vibrotactile feedback, ultrasound tactile feedback, thermal feedback.

Figure 5:
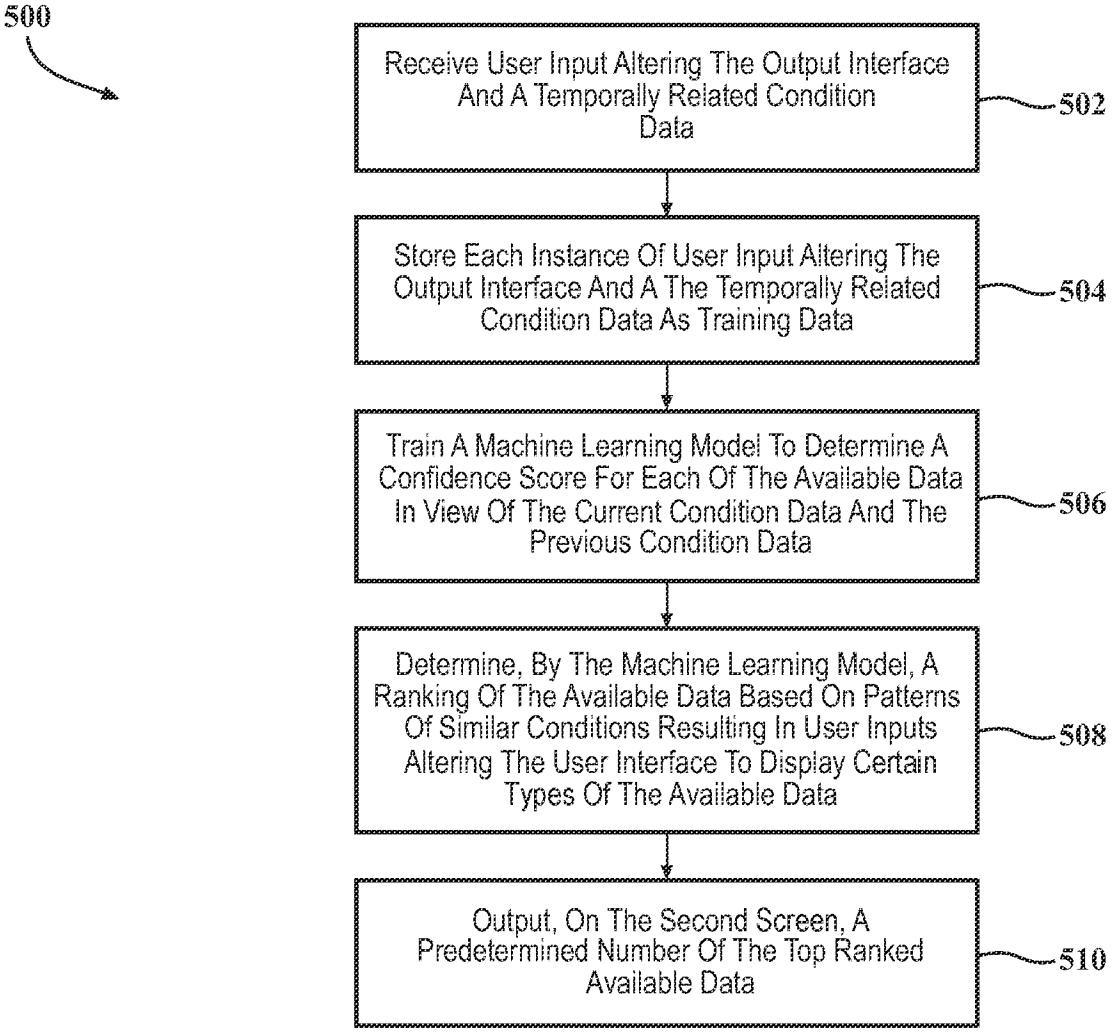
FIG. 5 generally illustrates an example block diagram of a method for communicating bullet drop compensation data and other relevant data, according to an embodiment of the present disclosure.

FIG. 5 generally illustrates process 500 detailing a method for refining bullet drop compensation calculations using a machine learning model. Computer system 100 may further comprise a machine learning (ML) model. The ML model may be a pretrained machine learning algorithm (e.g., classification model, regression model, clustering model, and the like), a deep learning neural network (e.g., multilayer perceptron, convolution neural network, recurrent neural network, and the like), or some combination thereof. In some embodiments, the process 500 is executed on the processor 104. In some embodiments, the machine learning model may be executed and stored on the removable device 202, the internet connected device 216, the system server, or any 3rd party server.

At 502, the process 500 receives from a user an input which may alter the output interface. For example, a user may determine that when a thunderstorm warning is in effect, the second screen 206 should show the current weather conditions. At 504, the process 500 stores the instance of user adjustment of the second screen 206 as well as condition data associated with the time the user made the adjustment. In some embodiments, the user adjustment and the temporally related condition data may be packaged as training data.

At 506, the process 500 trains a machine learning model based on the training data. In some embodiments, the machine learning model is pretrained based on annotated training data, training data created based on the activities of the user, training data based on other user's activities, or some combination thereof. In some embodiments, the machine learning model may be trained to generate a confidence score for all available and currently relevant information available to the removable device 202 in view of the currently relevant conditional data. In some embodiments conditional data may include weather, wind speed, wind direction, temperature, humidity, relative humidity, elevation, air pressure, or the like.

At 508, the process 500 may rank the currently available relevant information based on the confidence score generated by the machine learning model. The process 500 may also rank the currently available relevant information based on patterns of similar conditions which resulted in the user input adjusting the user interface to display specific types of the available data (i.e., in previous similar conditions the user prioritized certain available data). In some embodiments, the process 500 may remove from the rankings redundant information. For example, if a storm warning is a highly ranked information, than weather would be superfluous to show together so it may be removed. In some embodiments, any information displayed on the first display (currently or recently) may also be removed from the ranking.

At 510, the process 500 may output to the second screen 206 the top ranked available relevant information. The number of relevant information items that may be displayed is restricted based on the available screen real-estate in view of the size each information item occupies. For example, if the top ranked relevant information item takes up the entire second screen 206 than only the top ranked item is displayed.

It is understood that process 500 is intended as an iterative process. Each iteration of process 500 will generate new training data specific to the user. The greater amount of user training data, the more accurate the confidence scores generated by the machine learning model become.

It is understood that the present subject matter may be embodied in many different forms and should not be construed as being limited to the embodiments set forth herein. Rather, these embodiments are provided so that this subject matter will be thorough and complete and will convey the disclosure to those skilled in the art. Indeed, the subject matter is intended to cover alternatives, modifications, and equivalents of these embodiments, which are included within the scope and spirit of the subject matter as defined by the appended claims and their equivalents. Furthermore, in the detailed description of the present subject matter, numerous specific details are set forth in order to provide a thorough understanding of the present subject matter. However, it will be clear to those of ordinary skill in the art that the present subject matter may be practiced without such specific details.

Aspects of the present disclosure are described herein with reference to flowchart illustrations and/or block diagrams of methods, apparatuses (systems), and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

The non-transitory computer-readable media includes all types of computer-readable media, including magnetic storage media, optical storage media, and solid-state storage media and specifically excludes signals. It should be understood that the software can be installed in and sold with the device. Alternatively, the software can be obtained and loaded into the device, including obtaining the software via a disc medium or from any manner of network or distribution system, including, for example, from a server owned by the software creator or from a server not owned but used by the software creator. The software can be stored on a server for distribution over the Internet, for example.

Computer-readable storage media (medium) exclude (excludes) propagated signals per se, can be accessed by a computer and/or processor(s), and include volatile and nonvolatile internal and/or external media that is removable and/or non-removable. For the computer, the various types of storage media accommodate the storage of data in any suitable digital format. It should be appreciated by those skilled in the art that other types of computer readable medium can be employed such as zip drives, solid state drives, magnetic tape, flash memory cards, flash drives, cartridges, and the like, for storing computer executable instructions for performing the novel methods (acts) of the disclosed architecture.

The terminology used herein is for the purpose of describing particular aspects only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The aspects of the disclosure herein were chosen and described in order to best explain the principles of the disclosure and the practical application, and to enable others of ordinary skill in the art to understand the disclosure with various modifications as are suited to the particular use contemplated.

For purposes of this document, each process associated with the disclosed technology may be performed continuously and by one or more computing devices. Each step in a process may be performed by the same or different computing devices as those used in other steps, and each step need not necessarily be performed by a single computing device.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A removable optics attachment for a weapon, comprising:

a first display;

at least one sensor;

at least one wireless communication circuit for sending and receiving data; and a second display for displaying contextual information based on the environmental data and input by the user on the second display;

a processor programed to:

receive environmental data from an information network and the at least one sensor;

receive user account data from the information network;

determine bullet drop compensation data based on the environmental data and the user account data;

display the bullet drop compensation data on the first display;

adjust the bullet drop compensation data displayed on the first display based on an input from the user;

determine at least one priority information calculation based on a user history of inputs to the second display to adjust the contextual information displayed on the second display; and display the contextual information on the second display based on the at least one of the priority information calculations.

2. The removable optics attachment of claim 1 wherein the bullet drop compensation data includes a bullet drop compensation distance and a bullet drop compensation rate; and wherein the processor is programed to determine an appropriate scope adjustment value based on the bullet drop compensation distance and the bullet drop compensation rate.

3. The removable optics attachment of claim 1 wherein the at least one sensor is configured to detect an orientation of the weapon; and wherein the processor is programed to determine an orientation adjustment based on the orientation of the weapon and a target orientation for determining the bullet drop compensation data.

4. The removable optics attachment of claim 3 further comprising:

a feedback device for providing a notification to the user based on a comparison between the orientation of the weapon and the target orientation; and wherein the processor is programed to activate the feedback device in realtime as the user adjusts the weapon to match the orientation of the weapon to the target orientation.

5. The removable optics attachment of claim 1 wherein the user account data includes at least one of a caliber of a bullet, a bullet grain of the bullet, a barrel twist rate of the weapon, or a muzzle length of the weapon.

6. The removable optics attachment of claim 1 wherein the at least one sensor is selected from a group consisting of a barometer, a thermometer, an anemometer, a gyroscope, an accelerometer, a compass, and a GPS.

7. The removable optics attachment of claim 1 wherein the first display is a holographic projection inside of an ocular lens of a scope attached to the weapon.

8. The removable optics attachment of claim 1 further comprising:

a mounting ring;

a lens cap pivotally attached to the mounting ring, wherein the lens cap includes a second display; and wherein the processor is programed to display contextual information on the second display based on the environmental data and input by the user.

9. A method for determining bullet drop compensation for a weapon, the method comprising:

obtaining user data from a user, wherein the user data includes at least one of: a distance to a target, a scope attribute, a bullet caliber, a bullet grain, a muzzle length, or a barrel twist of the weapon;

obtaining conditional data from a sensor, wherein the conditional data includes at least one of: a weather reading, wind speed, wind direction, temperature, humidity, relative humidity, elevation, air pressure, location, an orientation of the weapon, or time;

obtaining informational data from an information network, wherein the informational data includes at least one of: a weather reading, elevation, an emergency warning, user account data, user history data, or time;

calculating bullet drop compensation data based on the user data, the conditional data, and the informational data;

generating a bullet drop compensation distance and a bullet drop compensation rate based on the bullet drop compensation data;

determining a scope adjustment value based on the bullet drop compensation distance, the bullet drop compensation rate, and the scope attribute;

displaying at least one of the scope adjustment value, the bullet drop compensation distance, or the bullet drop compensation rate on a first display;

displaying relevant data on a second display, wherein the relevant data is selected from the group consisting of the user data, conditional data, and the informational data; and adjusting relevant data displayed on the second display based on input from the user.

10. The method of claim 9 further comprising:

determining whether required data was not obtained from the user data, the conditional data, or the informational data, wherein the required data is required for the calculating bullet drop compensation step; and obtaining the missing data from the information network or from a default setting, wherein the default setting is supplied by the user or based on previous user data, conditional data, or informational data.

11. The method of claim 9 further comprising:

determining an orientation adjustment based on the bullet drop distance and the orientation of the weapon.

12. The method of claim 11 further comprising:

comparing the orientation of the weapon to the orientation adjustment as the user adjusts the orientation of the weapon; and outputting a notification to the user based on a comparison of the orientation of the weapon and the orientation adjustment.

13. The method of claim 9 further comprising:

storing the input from the user and the user data, the conditional data, and the informational data at the time of the input from the user as training data; and training a machine learning model with the training data.

14. The method of claim 13 wherein the relevant data displayed on the second is determined by the machine learning model;

wherein the machine learning model is configured to determine a confidence score for the relevant data based on the training data;

wherein the machine learning is configured to rank the relevant data based on the confidence score and based on patterns of the user previously adjusting the relevant data displayed on the second display when previous conditional data is similar to current conditional data; and wherein the relevant data displayed on the second display includes the relevant data with the highest rank.

15. A method of communicating bullet drop compensation to a user aiming a weapon, the method comprising:

obtaining user data from a user, wherein the user data includes at least one of: a distance to a target, a scope attribute, a bullet caliber, a bullet grain, a muzzle length, or a barrel twist of the weapon;

obtaining conditional data from a sensor, wherein the conditional data includes at least one of: a weather reading, wind speed, wind direction, temperature, humidity, relative humidity, elevation, air pressure, location, an orientation of the weapon, or time;

obtaining informational data from an information network, wherein the informational data includes at least one of: a weather reading, elevation, an emergency warning, user account data, user history data, or time;

calculating bullet drop compensation data based on the user data, the conditional data, and the informational data;

displaying the bullet drop compensation data on a first display of the weapon;

determining an orientation adjustment for the orientation of the weapon based on the bullet drop compensation data;

displaying the orientation adjustment on a second display of the weapon detecting a change in the orientation of the weapon; and outputting a notification to the user based on a comparison of the orientation of the weapon and the orientation adjustment.

16. The method of claim 15 further comprising:

determining an optical adjustment value for an optical attachment of the weapon based on the bullet drop compensation data and a measurement displayed by the optical attachment; and displaying the optical adjustment value on the second display.

17. The method of claim 15 further comprising:

displaying relevant data of a first set of conditional data on at least one of the first display or the second display;

receiving an input from a user to adjust the relevant data of the first set of conditional data displayed on the first display or second display;

storing the input from the user and the first set of conditional data as training data;

training a machine learning model with the training data;

obtaining a second set of conditional data;

generating a confidence score for the second set of conditional data based on the training data;

ranking the second set of conditional data based on the confidence score and based on the user adjusting the relevant data of the first set of conditional data displayed on the first display or the second display, wherein the first set of conditional data is similar to the second set of conditional data; and displaying the relevant data of the second set of conditional data with the highest rank on the first display or the second display.

* * * * *